US008790573B2

(12) United States Patent
Miyazaki et al.

(10) Patent No.: US 8,790,573 B2
(45) **Date of Patent: *Jul. 29, 2014**

(54) FERRITIC CR-CONTAINED STEEL

(75) Inventors: Atsushi Miyazaki, Tokyo (JP); Yasushi Kato, Tokyo (JP); Osamu Furukimi, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 268 days.

This patent is subject to a terminal disclaimer.

(21) Appl. No.: 10/583,220

(22) PCT Filed: Dec. 22, 2004

(86) PCT No.: PCT/JP2004/019709

§ 371 (c)(1),
(2), (4) Date: Jun. 16, 2006

(87) PCT Pub. No.: WO2005/064030

PCT Pub. Date: Jul. 14, 2005

(65) Prior Publication Data

US 2007/0144634 A1 Jun. 28, 2007

(30) Foreign Application Priority Data

Dec. 26, 2003 (JP) ..... 2003-434704

(51) Int. Cl.
*C22C 38/22* (2006.01)
*C22C 38/18* (2006.01)

(52) U.S. Cl.
USPC ..... 420/67; 420/61; 420/63; 148/325

(58) Field of Classification Search
USPC ..... 148/325; 420/61, 63, 67
See application file for complete search history.

(56) References Cited

U.S. PATENT DOCUMENTS

| | | | | |
|---|---|---|---|---|
| 5,626,694 | A * | 5/1997 | Kawabata et al. | 148/609 |
| 2002/0098107 | A1 * | 7/2002 | Miyazaki et al. | 420/69 |

FOREIGN PATENT DOCUMENTS

| | | | |
|---|---|---|---|
| EP | 6-136488 | | 5/1994 |
| EP | 1 207 214 | A2 | 5/2002 |
| EP | 1 553 198 | A1 | 7/2005 |
| JP | 06-88168 | A | 3/1994 |
| JP | 6-88168 | A | 6/1994 |
| JP | 8-35042 | A | 2/1996 |
| JP | 2002-4008 | | 1/2002 |
| JP | 2002146484 | A * | 5/2002 |
| JP | A-2002-212685 | | 7/2002 |
| JP | 2003-96506 | | 4/2003 |
| JP | 2003-213377 | | 7/2003 |

* cited by examiner

*Primary Examiner* — George Wyszomierski
*Assistant Examiner* — Caitlin Kiechle
(74) *Attorney, Agent, or Firm* — RatnerPrestia

(57) ABSTRACT

A ferritic Cr-contained steel having a reduced thermal expansion coefficient is provided. The ferritic Cr-contained steel contains C of 0.03% or less, Mn of 5.0% or less, Cr of 6 to 40%, N of 0.03% or less, Si of 5% or less, and W of 2.0% to 6.0% in percent by mass, and Fe and inevitable impurities as the remainder, wherein precipitated W is 0.1% or less in percent by mass, and an average thermal expansion coefficient between 20° C. and 800° C. is less than 12.6×10-6/° C.

7 Claims, 4 Drawing Sheets

FERRITIC CR-CONTAINED STEEL

TECHNICAL FIELD

The invention relates to ferritic Cr-contained steel having a low thermal expansion coefficient. This disclosure also relates to ferritic Cr-contained steel having a low thermal expansion coefficient suitable for applications in which a heat cycle is repeated between high temperature and low temperature, including exhaust system members of an automobile such as exhaust manifolds, exhaust pipes, converter case materials, and metal honeycomb materials; separators within a solid-oxide-type fuel cell; materials for interconnectors; materials for reformers as peripheral members of fuel cells; exhaust ducts of power generation plants; or heat exchangers. The thermal expansion coefficients described herein are linear expansion coefficient coefficients. It will hereinafter be abbreviated as thermal expansion coefficient.

BACKGROUND

In various members subjected to the repeated heat cycle between high temperature and low temperature, heat expansion and contraction are repeated, as a result both of the members themselves and peripheral members of them are added with strain or stress, and consequently fracture by thermal fatigue is prone to occur. In such a circumstance, the fracture by thermal fatigue is hardly to occur in an alloy having a lower thermal expansion coefficient, because heat strain and heat stress to be added become smaller. As a known method for decreasing the thermal expansion coefficient, use of Magneto-volume effects is given. This is a method for decreasing the thermal expansion coefficient in such a way that when temperature is decreased, strain corresponding to a level of essentially contracted strain is compensated by magnetostriction due to generation of Atomic magnetic momentum or change in amount of the momentum. To obtain such magneto-volume effects, temperature dependence of the generation or the change in amount of the atomic magnetic-momentum is important. For example, in Fe-36% Ni Invar alloy used for a shadow mask in a cathode ray tube of a display, since the amount of the Atomic magnetic momentum suddenly changes near the Curie temperature (230 to 279° C.), a sudden decrease in thermal expansion coefficient is exhibited at a temperature lower than the Curie temperature (a value of thermal expansion coefficient of the alloy at about 200° C., at which the alloy is used for the shadow mask, is extremely low, about $1\times10^{-6}$/° C.) However, the alloy has an extremely high thermal expansion coefficient of about $18\times10^{-6}$/° C. at 800° C., which is in at the same level as in a typical austenitic stainless steel. Furthermore, the alloy contains Ni as much as 36%, resulting in an extreme increase in cost, consequently it is hard to be used for such an application in general consumer goods. From such reasons, Fe—Cr base alloys are widely used for the application. However, the Fe—Cr base alloys have a small temperature dependence of amount of the Atomic magnetic momentum is small, therefore the Magneto-volume effect is not observed even at a temperature of the Curie temperature or lower. In this way, decrease in thermal expansion coefficient due to Magneto-volume effect is difficult in the Fe—Cr base alloys. Therefore, in the related art, thermal fatigue life has been improved by a method using improvement in strength or high ductility by forming a high alloy (JP-A-2003-213377 and JP-A-2002-212685). However, improved strength by forming the high alloy necessarily causes a problem of reduction in workability, and orientation of high ductility causes strength to be extremely lowered, consequently it is pointed that another problem (for example, fatigue at elevated temperature) may occur. From such a situation, a new method has been strongly required for improving the thermal fatigue life by reducing the thermal expansion coefficient of Fe—Cr ferritic alloys.

SUMMARY

We found that addition of W to the Fe—Cr ferritic alloys and a decrease in the amount of precipitated W remarkably contributed to a decrease in thermal expansion coefficient of the alloys. While a the mechanism of this has not been clarified, since it is known that the thermal expansion coefficient of the alloys also depends on specific heat and bulk modulus, it is believed that addition of W has an effect on the coefficient through the temperature dependence of the amount of the Atomic magnetic momentum. An especially important point is that simple addition of W is not sufficient, and large amount of precipitated W rather increases the thermal expansion coefficient. The precipitated state of W is a precipitated state mainly in a form of the Laves phase ($Fe_2M$-type intermetallic compounds) or carbides, and when W is in a state of precipitated W, it inhibits a decrease in the thermal expansion coefficient. While the reason for this is not clear, we believe it is because of the following two points. The first point is considered as follows: while grain boundaries essentially act as a cushion for thermal expansion, since the Laves phase is precipitated therein, the cushion effect is reduced, and consequently the thermal expansion coefficient is increased.

The second point is considered as follows: when the amount of the precipitated W is increased in the alloy, the amount of solid soluted W is decreased, and consequently a decrease in the thermal expansion coefficient of the alloy is inhibited. However, even if the amount of precipitated W is slight, for example, only more than 0.1%, the decrease in thermal expansion coefficient of the alloy is inhibited, therefore the reason can not be explained only from the increase in the amount of dissolved W in the alloy. Thus, the former reason, a decrease in effect as a cushion of the grain boundaries is considered to be major. Therefore, component design of a material suitable for the environment in which heat cycle is applied can be realized by considering the knowledge on thermal expansion coefficient in addition to knowledge in the related art, that is, influence of various additional-elements on other properties such as workability, oxidation resistance, and corrosion resistance.

Select aspects of the disclosure include:

1. Ferritic Cr-contained steel containing C of 0.03% or less, Mn of 5.0% or less, Cr of 6 to 40%, N of 0.03% or less, Si of 5% or less, and W of 2.0% to 6.0% in percent by mass, and Fe and inevitable impurities as the remainder, wherein precipitated W is 0.1% or less in percent by mass, and an average thermal expansion coefficient between 20° C. and 800° C. is less than $12.6\times10_{-6}$/° C.
2. The ferritic Cr-contained steel according to 1, further containing at least one selected from a group of Nb of 1% or less, Ti of 1% or less, Zr of 1% or less, Al of 1% or less, and V of 1% or less in percent by mass.
3. The ferritic Cr-contained steel according to 1 or 2, further containing Mo of 5.0% or less in percent by mass.
4. The ferritic Cr-contained steel according to any one of 1 to 3, further containing at least one selected from a group of Ni of 2.0% or less, Cu of 3.0% or less, and Co of 1.0% or less in percent by mass.

5. The ferritic Cr-contained steel according to any one of 1 to 4, further containing at least one selected from a group of B of 0.01% or less and Mg of 0.01% or less in percent by mass.
6. The ferritic Cr-contained steel according to any one of 1 to 5, further containing one or two of REM of 0.1% or less and Ca of 0.1% or less in percent by mass.
7. A manufacturing method of ferritic Cr-contained steel, wherein a composition of molten steel is adjusted to include C of 0.03% or less, Mn of 5.0% or less, Cr of 6 to 40%, N of 0.03% or less, Si of 5% or less, and W of 2.0% to 6.0% in percent by mass, and Fe and inevitable impurities as the remainder; and then the molten steel is formed into a steel slab; and then the slab is hot-rolled and then subjected to hot-rolled-sheet annealing at a hot-rolled-sheet annealing temperature of 950 to 1150° C. and descaling; and furthermore, a hot rolled and annealed sheet is cold-rolled and then subjected to finish annealing at a finish annealing temperature of 1020° C. to 1200° C., so that precipitated W is 0.1% or less in percent by mass.
8. The manufacturing method of ferritic Cr-contained steel according to 7, wherein the composition of the molten steel further includes at least one selected from a group of Nb of 1% or less, Ti of 1% or less, Zr of 1% or less, Al of 1% or less, and V of 1% or less in percent by mass.
9. The manufacturing method of ferritic Cr-contained steel according to 7 or 8, wherein the composition of the molten steel further includes Mo of 5.0% or less in percent by mass.
10. The manufacturing method of ferritic Cr-contained steel according to 7 to 9, wherein the composition of the molten steel further includes at least one selected from a group of Ni of 2.0% or less, Cu of 3.0% or less, and Co of 1.0% or less in percent by mass.
11. The manufacturing method of ferritic Cr-contained steel according to 7 to 10, wherein the composition of the molten steel further includes at least one selected from a group of B of 0.01% or less and Mg of 0.01% or less in percent by mass.
12. The manufacturing method of ferritic Cr-contained steel according to 7 to 11, wherein the composition of the molten steel further includes one or two of REM of 0.1% or less and Ca of 0.1% or less in percent by mass.

While the amount of "precipitated W" means mass percent of W precipitated mainly in a form of the Laves phase or carbides, mass percent of W precipitated in a form of another phase is also included. The mass percent of "precipitated W" was measured by inductively coupled plasma atomic emission spectrometry (ICP-AES). That is, a sample is electrolyzed at a constant current (current density≤20 mA/cm$^2$) using a 10% acetylacetone-base electrolyte (commonly called AA solution). Electrolysis residue in the electrolytic solution is collected by filtration, then fused in alkali (sodium peroxide and metaboric lithium), and then dissolved in an acid and then diluted into a certain quantity by water. The solution is subjected to measurement of the amount of W ($W_p$) in the solution using an ICP emission spectrometer (Inductively Coupled Plasma Spectrometer). The amount of precipitated W (mass percent) can be obtained by the following formula:

$$\text{the amount of precipitated } W(\text{mass percent}) = (W_p/\text{sample weight}) \times 100.$$

The thermal expansion coefficient has temperature dependence even if a ferrite structure is remained as it is. Thus, average thermal expansion coefficient in use a real world environment is practically important. Therefore, we defined an average thermal expansion coefficient between 20° C. and 800° C. The average thermal expansion coefficient between 20° C. and 800° C. described herein means a value of an elongation ratio in one direction of a steel sheet in the case of heating the steel sheet to 20° C. to 800° C. which is divided by temperature difference 780° C. between 20° C. and 800° C. However, since the Cr-contained steels effectively acts on decrease in thermal expansion coefficient even out of the temperature range, it will be appreciated that the limitation of the temperature range is not intended to limit the temperature in use a real world environment to the range of 20° C. to 800° C.

Ferritic Cr-contained steel having a low thermal expansion coefficient compared with ferritic Cr-contained steel in the related art can be obtained. Thermal fatigue life at 100 to 800° C. of such a material having a low thermal expansion coefficient exhibits an excellent value compared with steels in the related art (ferritic stainless steel, Type 429Nb (JIS G4307) and ferritic heat-resistant steel, sheet SUH409L (JIS G4312)).

Therefore, the steel is used in a region to which heat cycle is applied, thereby thermal stress to the peripheral member and the steel itself is reduced, and therefore a problem in design for improving the life, or complicated design for reducing the thermal strain is not necessary. Therefore, the steels can be preferably used for applications of components to which heat cycle is applied, including the exhaust system components of the automobile, separators within the fuel cell, materials for interconnectors, materials for reformers, exhaust ducts of the power generation plants, or heat exchangers.

DETAILED DESCRIPTION

Figure 1:
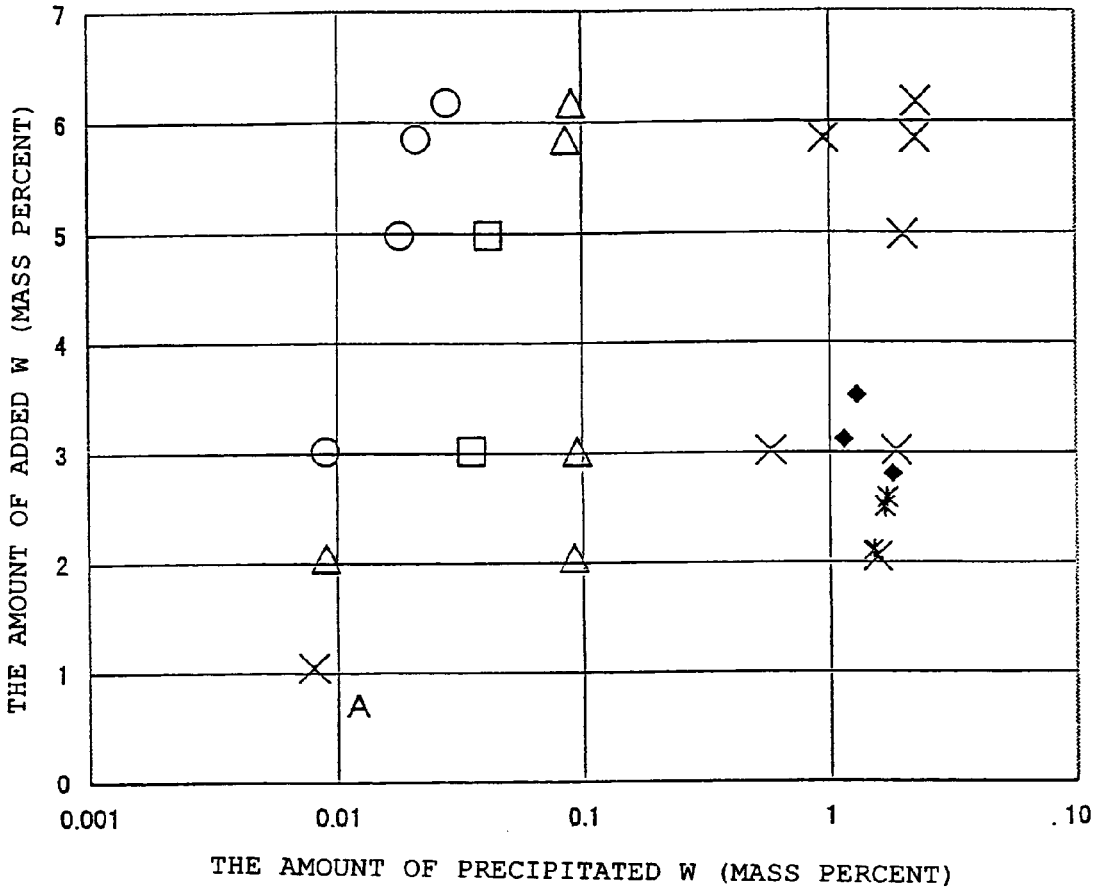
FIG. 1 is a diagram showing influence of the amount of added W and the amount of precipitated W on an average thermal expansion coefficient between 20 and 800° C. of ferritic Cr-contained steel having a basic composition of 15% Cr-0.5% Nb-1.9% Mo.

Hereinafter, the reason for selecting elements to be in the composition within the above range is described. In the description, representation in "%" is representation in mass percent unless otherwise specified.

C: 0.03% or Less

Since C deteriorates toughness and workability, incorporation of C is preferably reduced at maximum. From the point, the amount of C was limited to about 0.03% or less in the invention. Preferably, the amount is about 0.008% or less.

Mn: 5.0% or Less

Mn is added for improving toughness. To obtain the effect, the amount of Mn of 0.1% or more is preferable. However, since excessive addition of Mn may cause formation of MnS, which deteriorates corrosion resistance, the amount was limited to about 5.0% or less. Preferably the amount is about 0.1% to about 5.0%, and more preferably about 0.5% to about 1.5%.

Cr: 6 to 40%

Cr is also effective for improving corrosion resistance and oxidation resistance. Since W of 2.0% or more is added, if Cr of 6% or more exists in steel, the steel can be used for many applications from a point of corrosion resistance or oxidation resistance. In particular, when high-temperature oxidation resistance is regarded as important, Cr of 14% or more is preferably contained. When the amount of Cr exceeds 40%, embrittlement in material becomes significant; therefore the amount was determined to be about 40% or less. When workability is regarded as important, the amount of Cr is preferably less than about 20%, and more preferably less than about 17%.

Moreover, Cr is effective for decrease in thermal expansion coefficient, and in the light of this point, the amount of about 14% or more is preferable.

N: 0.03% or Less

Since N deteriorates toughness and workability similarly as C, incorporation of N is preferably reduced at maximum. From this point, the amount of N was limited to about 0.03% or less. More preferably, the amount is about 0.008% or less.

Si: 5% or Less

Si is added for improving oxidation resistance. To obtain the effect, the amount of Si is preferably 0.05% or more. When the amount exceeds 5%, strength at room temperature is increased, which deteriorates workability, therefore the upper limit of the amount was determined to be about 5%. Preferably, the amount is about 0.05% to about 2.00%.

W: 2.0% to 6.0%

W is an extremely important element. Since addition of W largely reduces thermal expansion coefficient, the amount of W was determined to be about 2.0% or more. However, when the amount is excessively increased, strength at room temperature is increased, which deteriorates workability, therefore the upper limit of the amount was determined to be about 6.0%. Preferably, the amount is about 2.5% to about 4%, and more preferably about 3% to about 4%.

Precipitated W: 0.1% or Less

The precipitated W is precipitated mainly in the form of the Laves phase or carbides. When the precipitated W exceeds 0.1%, the effect of decrease in thermal expansion coefficient due to addition of W is small. Therefore, the upper limit of the amount of precipitated W was determined to be about 0.1% or less. Preferably, the amount is about 0.05% or less, and more preferably about 0.03% or less. The lower amount is more preferable. However, finish annealing temperature must be increased significantly in order to restrain the precipitated W to be less than 0.005%, which results in extremely coarsened crystal grains, consequently orange peel occurs during working, cause a crack during working. Therefore, particularly when the steel of the application is used for an application requiring working, it is more preferable that the amount of precipitated W is substantially about 0.005% or more. While the amount of "precipitated W" means mass percent of W precipitated mainly in the form of the Larves phase or carbides, it may include mass percent of W precipitated in a form of another phase. In measurement of the mass percent of "precipitated W", the electrolysis residue was measured in the inductively coupled plasma atomic emission spectrometry as described before.

Hereinbefore, while basic components have been described, in addition to this, the following elements can be appropriately contained as necessary in the invention.

At Least One Selected from Nb of about 1% or Less, Ti of about 1% or Less, Zr of about 1% or Less, Al of About 1% or Less, and V of About 1% or Less Any of Nb, Ti, Zr, Al and V acts to fix C or N and thus improves intergranular corrosion resistance, and from this point, each of them is preferably contained about 0.02% or more. However, when the amount exceeds 1%, embrittlement of steel is caused; therefore they are determined to be contained about 1% or less respectively.

Mo: 5.0% or Less

Mo may be added because it improves corrosion resistance. While the effect appears at the amount of about 0.02% or more, excessive addition of Mo deteriorates workability, therefore the amount of about 5.0% was determined as the upper limit. The amount is preferably about 1% to about 2.5%.

At Least One Selected from Ni of 2.0% or Less, Cu of 3.0$ or Less, and Co of 1.0% or Less Any of Ni, Cu, and Co is a useful element for improving toughness, and Ni of about 2.0% or less, Cu of about 3.0% or less, and Co of about 1.0% or less were determined to be contained respectively. Ni of about 0.5% or more, Cu of about 0.3% or more, and Co of about 0.01% or more are preferably added so that effects of the elements are sufficiently exhibited.

At Least One Selected from B of 0.01% or Less and Mg of 0.01% or Less

Both of B and Mg effectively contribute to improvement in secondary embrittlement. To obtain the effect, B of about 0.0003% or more and Mg of about 0.0003% or more are preferable respectively. However, in each of B and Mg, when the amount exceeds 0.01%, strength at room temperature is increased, causing deterioration in ductility, therefore they are determined to be contained about 0.01% or less respectively. More preferably, B is about 0.002% or less, and Mg is about 0.002% or less.

At Least One REM of 0.1% or Less and Ca of 0.1% or Less

REM and Ca effectively contribute to improvement in oxidation resistance. To obtain the effect, REM of about 0.002% or more and Ca of about 0.002% or more are preferable respectively. However, since excessive addition of them deteriorates corrosion resistance, they are determined to be contained about 0.1% or less respectively. In the invention, REM means lanthanoid series elements and Y. In particular, when Ti is contained, Ca effective contributes also to prevention of nozzle clogging during continuous casting. The effect becomes significant at the Ca amount of about 0.001% or more.

Next, a microstructure of a steel sheet is described. A structure of steel manufactured using a technique of the application is substantially a ferrite single phase. While the steel may have a structure partially containing bainite, in a condition that cooling has been performed after hot rolling and coiling, steel after cold rolling and annealing substantially has the structure of the ferrite single phase. In the steel of the application, component design is made such that hard martensite is not formed in a condition before working such as cold rolling and annealing.

Next, a preferred manufacturing method of the steel is described. Manufacturing conditions of the steel is not particularly limited except that the hot-rolled sheet annealing temperature and the finish annealing temperature are determined to obtain precipitated W of 0.1% or less, and a typical manufacturing method of the ferritic stainless steel can be preferably used.

For example, molten steel that has been adjusted in the appropriate composition range is ingoted using an ingot furnace such as a converter and an electric furnace, or using refining such as ladle refining and vacuum refining, and then an ingot is formed into a slab by an ingot casting-blooming method, and then the slab is hot-rolled. Furthermore, a hot-rolled and annealed sheet is subjected to hot-rolled sheet annealing in which temperature is controlled to be in a predetermined temperature range, and then subjected to pickling. Furthermore, a hot-rolled sheet is subjected to cold rolling, and then a cold-rolled and annealed sheet is subjected to finish annealing in which temperature is controlled to be in a predetermined temperature range, and subjected to pickling. A cold rolled and annealed sheet is preferably formed sequentially through the above process.

In a more preferable manufacturing method, part of conditions of a hot rolling process and a cold rolling process are made to be specific conditions. In steel making, it is preferable that molten steel containing the essential components and components added as necessary is ingoted in the converter or the electric furnace, and then an ingot is subjected to secondary refining by a VOD method. While the molten steel formed into the ingot can be formed into a steel material according to a known manufacturing method, continuous casting is preferably used in the light of productivity and quality. A steel material obtained by the continuous casting is heated, for example, to about 1000 to about 1250° C., and then formed into a hot-rolled sheet having a desired thickness. Naturally, the material can be worked into other forms than a sheet material. The hot-rolled sheet is subjected to batch annealing or continuous annealing at about 950 to about 1150° C., and more preferably about 1020 to about 1150° C., and then descaled by pickling and the like to be formed into a hot-rolled sheet product. Shot blasting may be performed for descaling before pickling as necessary.

Furthermore, the obtained hot rolled and annealed sheet is formed into a cold-rolled sheet through the cold rolling process. In the cold rolling process, at least two steps of cold rolling including intermediate annealing may be performed as necessary for production reasons. Total reduction rate during the cold rolling process including one or at least two steps of cold rolling is made to be about 60% or more, preferably about 62% or more, and more preferably about 70% or more. A cold rolled sheet is subjected to continuous annealing (finish annealing) at about 1020° C. to about 1200° C. and more preferably about 1050° C. to about 1150° C., and then subjected to pickling to be formed into a cold rolled and annealed sheet. In some applications, light rolling (for example, skin-pass rolling) can be applied after cold rolling and annealing to adjust a shape of the steel sheet or quality.

A cold rolled and annealed sheet product manufactured in this way is used to form exhaust pipes of the automobile or a motorcycle, an outer casing material of a catalyst and exhaust duct of a thermal power plant, the heat exchanger, or fuel-cell-related members (including the separator, interconnector, and reformer) by performing bending and the like to the product depending on respective applications. A welding method for welding the members is not particularly limited, and typical arc welding methods such as MIG (Metal Inert Gas), MAG (Metal Active Gas) and TIG (Tungsten Inert Gas), laser welding, resistance welding methods such as spot welding and seam welding, high-frequency resistance welding such as a electric resistance welding, and high frequency induction welding can be used.

Particularly, it is important to determine the hot-rolled sheet annealing temperature and the finish annealing temperature to obtain precipitate W of 0.1% or less.

(1) Hot-rolled-sheet annealing temperature: 950° C. to 1150° C., and finish annealing temperature: 1020° C. to 1200° C.

When temperature of hot-rolled-sheet annealing is less than 950° C., large amount of precipitated W is remained in steel; therefore unless temperature of subsequent finish annealing exceeds 1200° C., the amount of precipitated W of cold rolled and annealed sheet does not satisfy W≤0.1%. However, when the finish annealing temperature is set to be more than 1200° C., a finish-annealed structure is significantly coarsened, causing orange peel. On the other hand, when the hot-rolled-sheet annealing temperature is more than 1150° C., a hot rolled and annealed structure having coarse crystal grains is formed, and consequently toughness of the hot rolled sheet is deteriorated, which causes break of a coil during cold rolling. Accordingly, the hot-rolled-sheet annealing temperature is preferably 950 to 1150° C., and more preferably 1020° C. to 1150° C. The finish annealing temperature is set to be 1020° C. to 1200° C., and more preferably 1050° C. to 1150° C. under such a hot-rolled-sheet annealing temperature condition, thereby precipitated W of 0.1% or less can be obtained.

Example 1

50 kg steel ingots having compositions as shown in Table 1 (examples according to selected aspects of the invention, comparative steels and steels in the related art (Type 429Nb, SUH409L)) were prepared, and then these steel ingots were heated to 1100° C., and then formed into hot rolled sheets 4 mm in thickness by hot rolling. Next, the hot rolled sheets were sequentially subjected to hot-rolled-sheet annealing (annealing temperature: 1090° C.), pickling, cold rolling (reduction rate: 62.5%), finish annealing (annealing temperature was changed from 900° C. to 1220° C. as shown in Table 1, and the sheets were held for three minuets at respective temperatures, and then air-cooled, so that the amount of precipitated W was adjusted), and pickling, consequently 1.5 mm thick steel sheets were formed.

Thermal expansion coefficients of the cold rolled and annealed sheets obtained in this way were examined. Results of examinations are listed together in Table 1.

Average thermal expansion coefficients between 20° C. and 800° C. were measured and evaluated as follows.

The average thermal expansion coefficient between 20° C. and 800° C. were measured in Ar at the heating rate of 5° C./min using specimens 1.5 mm thick by 5 mm width by 20 mm long (end faces are polished by emery No. 320) and using vertical thermal dilatometer DL-7000 manufactured by SINKU-RIKO, Inc.

Evaluation criteria are as follows.

The ferritic stainless in the related art (No. F, G in Table 1 (continuance 1)) has a thermal expansion coefficient of about $12.6\times10^{-6}$/° C. (average thermal expansion coefficient between 20 and 800° C.). Even if heat resistance temperature is improved 30° C. (830° C.), if about the same thermal strain is exhibited, improvement in heat resistance is expected by 30° C. Thus, effects of it were confirmed by actual thermal fatigue tests. That is, a thermal expansion coefficient $\alpha$ that satisfies $(12.6\times10^{-6}/°\ C.)\times(800-20)°\ C.>\alpha(830-20)°\ C.$, or a thermal expansion coefficient $\alpha\leq12.1\times10^{-6}/°$ C. is one of the standards. Naturally, the fact remains that the thermal expansion coefficient $\alpha$ of smaller than $12.6\times10^{-6}/°$ C. is effective for improvement in heat resistance. Thus, the followings were defined: when the steel sheets were measured between 20 and 800° C.;

Less than $11.7\times10^{-6}$: lank A, shown by O in FIG. 1;

$11.7\times10^{-6}$ or more and less than $12.1\times10^{-6}$: lank B, shown by □ in FIG. 1;

$12.1\times10^{-6}$ or more and less than $12.6\times10^{-6}$: lank C, shown by Δ in FIG. 1; and More than $12.6\times10^{-6}$: lank D, shown by x, * and ♦ in FIG. 1.

The amount of precipitated W was measured by inductively coupled plasma atomic emission spectrometry (ICP-AES). That is, a sample was electrolyzed at constant-current (current density≤20 mA/cm$^2$) using a 10% acetylacetone-base electrolyte (commonly called AA solution). Electrolysis residue in the electrolytic solution was collected by filtration, then fused in alkali (sodium peroxide and metaboric lithium), and then dissolved in an acid and then diluted into a certain quantity by water. The solution was subjected to measurement of the amount of W ($W_p$) in the solution using the ICP emission spectrometer (Inductively Coupled Plasma Spectrometer). The amount of precipitated W (mass percent) was obtained by the following formula;

$$\text{the amount of precipitated } W(\text{mass percent})=(W_p/\text{sample weight})\times100.$$

Test pieces for evaluation of the amount of precipitated W were sampled from two points adjacent to thermal expansion test pieces in a steel sheet, and an average value of the two was determined as a value of precipitated W.

Results of measurement are shown in Table 1 and FIG. 1. In FIG. 1, No. A to E, and No. I, J, K, L and M; steel of the invention No. 1 to 7 and 20 to 21; and examples in the related art No. P, Q, R, S, T and U are shown. Steel of No. 1, 2 and No. B; steel of No. 3, 4, 5, C, D, N and O; steel of No. 6, 7 and No. E; steel of No. 20, 21, I, J; and steel of No. K, L and M are in the same composition, respectively. It is known from FIG. 1 that when W of at least 0.1 exists in the form of the precipitated W, the thermal expansion coefficient is significantly decreased. The comparative steel No. H exhibits a high thermal expansion coefficient even if the amount of W and precipitated W are adjusted within the range of the invention, because it contains Cr of which the amount is out of the range of the invention. The steel No. F and G, which are steel in the related art shown for reference, exhibit high thermal expansion coefficients because the amount of W and precipitated W are out of the range of the invention. In the steel No. K, L and M, since the amount of W exceeds 6%, cracks occurred in bending portions in an adherence bending test (based on JIS B 7778), and consequently workability was bad. In the steel No. N, since the finish annealing temperature exceeded the upper limit of the range of the invention, orange peel occurred in bending portions in an adherence bending test (based on JIS B 7778), in addition, cracks occurred in some parts. In the steel No. P, Q, R, S, T and U, which are examples in the related art previously developed by the inventors, since the finish annealing temperature is below the lower limit of the range of the invention of the application, the amount of precipitated W is out of the range of the invention, and consequently a high thermal expansion coefficient is exhibited. Any of other steel No. 8 to 19 of the invention exhibited a low thermal expansion coefficient.

Figure 2:
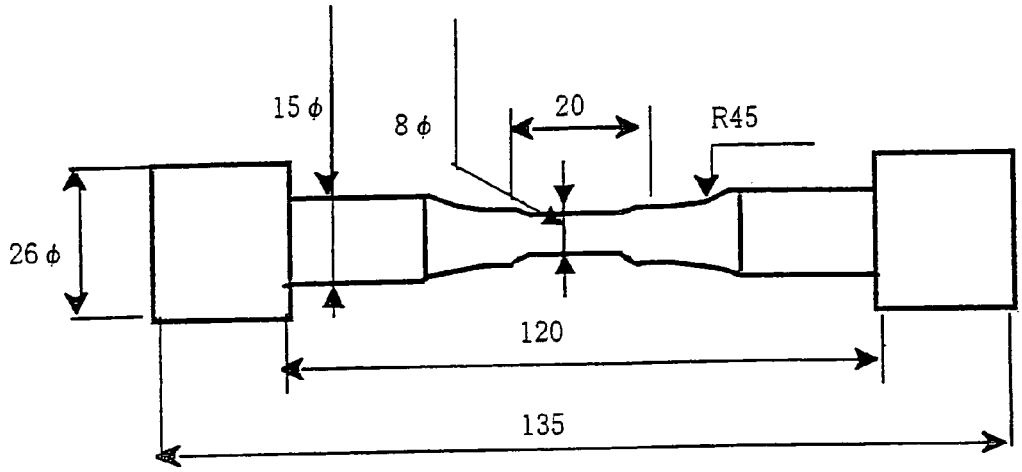
FIG. 2 is a view of a test piece for thermal fatigue test (unit of numeral values is mm)
Figure 3:
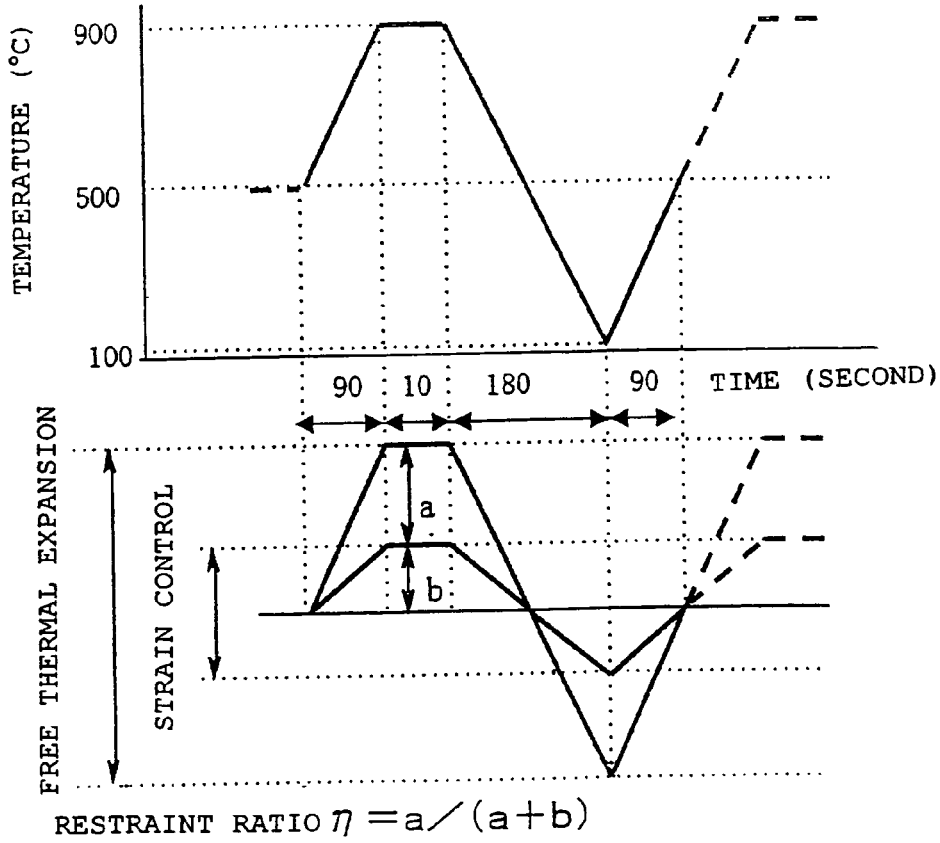
FIG. 3 is views showing heat cycle and restraining conditions, wherein thermal fatigue life was evaluated in a way that assuming that minimum temperature was 100° C. and maximum temperature was 900° C. as a heat cycle condition, and strain was zero at 500° C. (intermediate temperature between 100° C. and 900° C.), and strain due to free thermal expansion was controlled such that a restraint ratio was 0.35.
Figure 4:
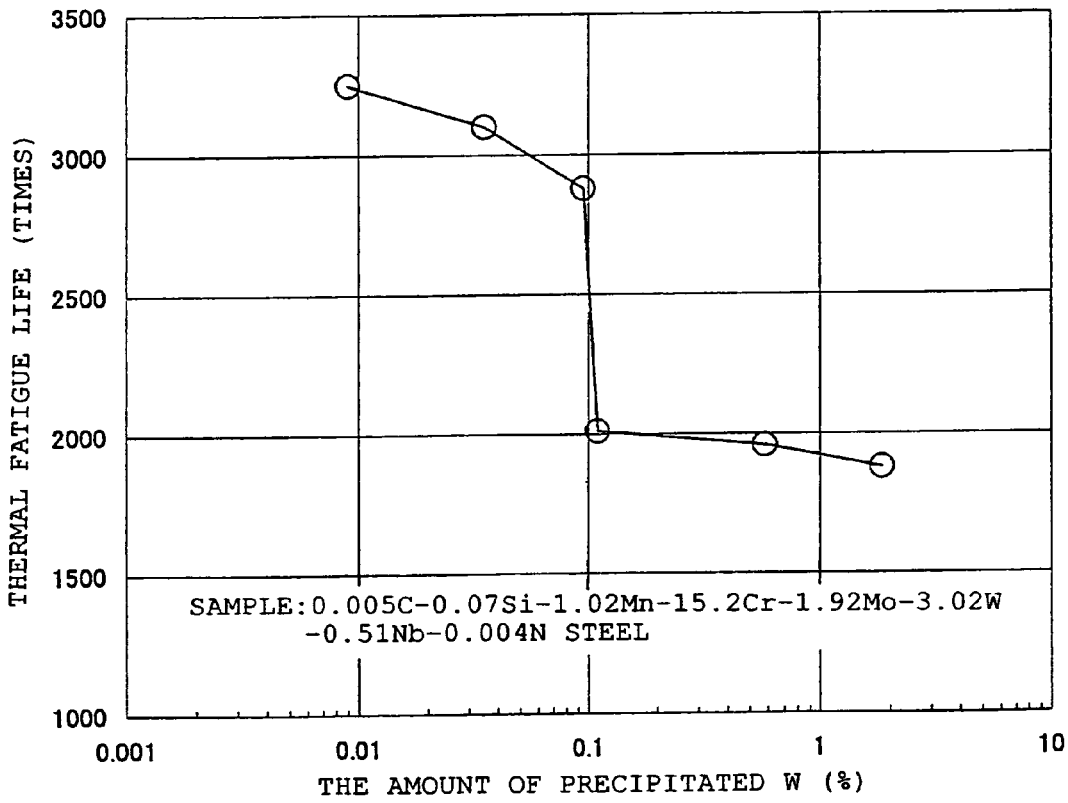
FIG. 4 is a diagram showing a relation between the amount of precipitated W and the thermal fatigue life of the ferritic Cr-contained steel having the basic composition of 15% Cr-0.5% Nb-1.9% Mo.

From round bars in which compositions and heat treatment conditions of the steel No. 3 to 5, and No. C, D and O in Table 1 were implemented, two test pieces as shown in FIG. 2 were prepared and subjected to thermal fatigue test respectively. A condition of the thermal fatigue test was determined according to heat cycle as shown in an upper view of FIG. 3. It was determined that the heating rate from 100° C. to 900° C. was 4.4° C./sec, the test pieces were held at 900° C. for 10 sec, the cooling rate from 900° C. to 100° C. was 4.4° C./sec, and one cycle period was 370 sec. The test was carried out in a way that strain due to free thermal expansion was controlled such that a restraint ratio coefficient was 0.35 between 100° C. and 900° C. Assuming that maximum tensile load generated at the fifth cycle, at which a load-strain hysteresis loop become stable, was defined as 100%, and a cycle number at a point where the maximum tensile load was decreased to less than 70% of the maximum tensile load was defined as thermal fatigue life. Results of obtained thermal fatigue life for respective two test pieces were averaged, and an averaged value was determined as the thermal fatigue life. FIG. 4 shows a relation between the amount of precipitated W in ferritic Cr-contained steel and thermal fatigue life of the steel. It is known from FIG. 4 that the thermal fatigue life is remarkably improved as high as 1.4 times or more at the amount of precipitated W of 0.1% or less.

Example 2

Next, a relation between the amount of precipitated W and the hot-rolled-sheet annealing temperature was investigated. A 50 kg steel ingots having a composition of C of 0.005%, Si of 0.07%, Mn of 1.02%, Cr of 15.2%, Mo of 1.92%, W of 3.02%, Nb of 0.51% and N of 0.004% were prepared, and then these steel ingots were heated to 1100° C., and then formed into hot rolled sheets 4 mm in thickness. Next, the hot rolled sheets were sequentially subjected to hot-rolled-sheet annealing (annealing temperature was changed from 900° C. to 1200° C., and the sheets were held for three minuets at respective temperatures, and then air-cooled), pickling, cold rolling (reduction rate: 62.5%), finish annealing (the sheets were held for three minuets at the finish annealing temperature of 1100° C., and then air-cooled), and pickling, consequently 1.5 mm thick steel sheets were formed.

The amount of precipitated W in the cold rolled and annealed sheets obtained in this way were measured in the same manner as in the Example 1. Test pieces for evaluation of the amount of precipitated W were sampled from two points in respective steel sheets, and each average value of the two was determined as a value of precipitated W.

Figure 5:
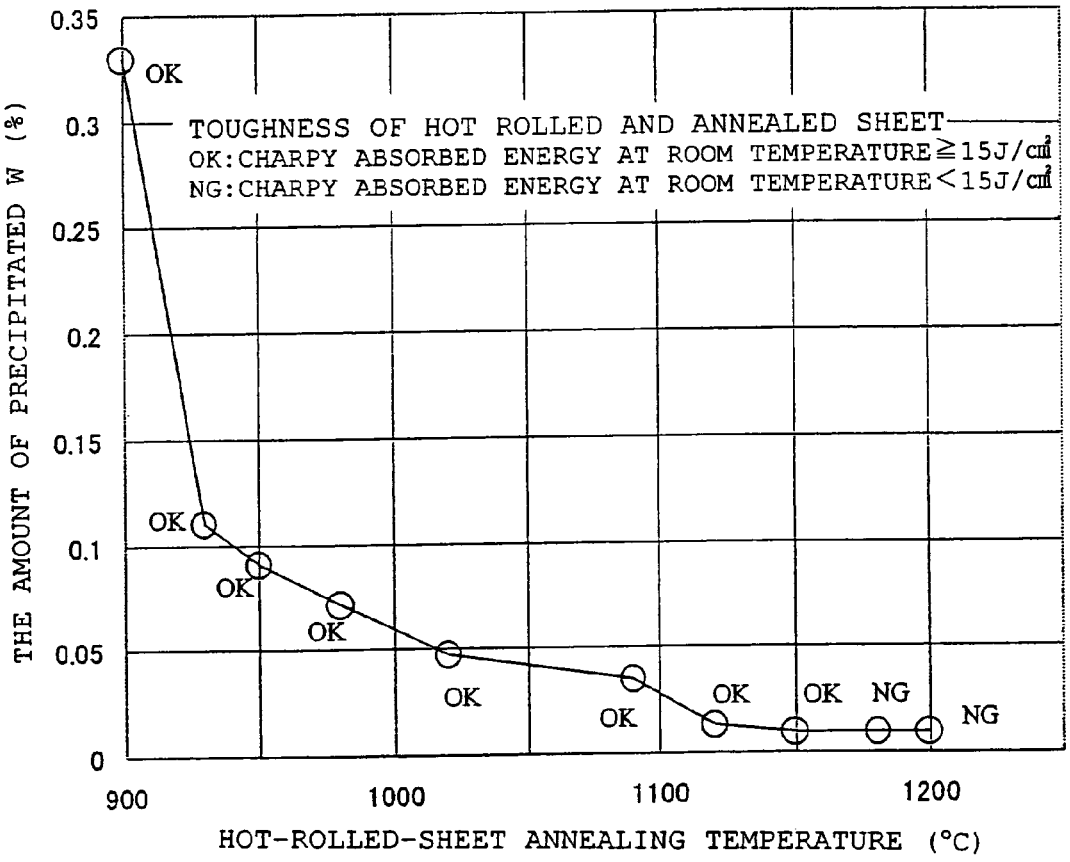
FIG. 5 is a diagram showing influence of hot-rolled-sheet annealing temperature on the amount of precipitated W of a cold rolled and annealed steel sheet of the ferritic Cr-contained steel having the basic composition of 15% Cr-0.5% Nb-1.9% Mo.

FIG. 5 shows influence of the hot-rolled-sheet annealing temperature on the amount of precipitated W. It is known from FIG. 5 that the hot-rolled-sheet annealing temperature is preferably 950 to 1150° C., and more preferably 1020 to 1150° C.

TABLE 1

| No. | C | Si | Mn | Cr | Mo | W | Nb | N | other | Precipitated W | Average thermal expansion coefficient between 20° C. and 800° C. | Finish annealing temperature (° C.) | remarks |
|---|---|---|---|---|---|---|---|---|---|---|---|---|---|
| A | 0.012 | 0.45 | 0.99 | 15.2 | 1.85 | 1.05 | 0.55 | 0.014 | | 0.008 | D | 1100 | Comparative steel |
| 1 | 0.003 | 0.35 | 1.05 | 14.8 | 1.88 | 2.05 | 0.52 | 0.008 | | 0.009 | C | 1100 | Example of the invention |

TABLE 1-continued

| No. | C | Si | Mn | Cr | Mo | W | Nb | N | other | Precipitated W | Average thermal expansion coefficient between 20° C. and 800° C. | Finish annealing temperature (° C.) | remarks |
|---|---|---|---|---|---|---|---|---|---|---|---|---|---|
| 2 | 0.003 | 0.35 | 1.05 | 14.8 | 1.88 | 2.05 | 0.52 | 0.008 | | 0.092 | C | 1080 | Example of the invention |
| B | 0.003 | 0.35 | 1.05 | 14.8 | 1.88 | 2.05 | 0.52 | 0.008 | | 1.540 | D | 1000 | Comparative steel |
| 3 | 0.005 | 0.07 | 1.02 | 15.2 | 1.92 | 3.02 | 0.51 | 0.004 | | 0.009 | A | 1180 | Example of the invention |
| 4 | 0.005 | 0.07 | 1.02 | 15.2 | 1.92 | 3.02 | 0.51 | 0.004 | | 0.035 | B | 1100 | Example of the invention |
| 5 | 0.005 | 0.07 | 1.02 | 15.2 | 1.92 | 3.02 | 0.51 | 0.004 | | 0.095 | C | 1080 | Example of the invention |
| C | 0.005 | 0.07 | 1.02 | 15.2 | 1.92 | 3.02 | 0.51 | 0.004 | | 0.580 | D | 1010 | Comparative steel |
| D | 0.005 | 0.07 | 1.02 | 15.2 | 1.92 | 3.02 | 0.51 | 0.004 | | 1.850 | D | 950 | Comparative steel |
| 6 | 0.002 | 0.08 | 0.99 | 15.1 | 1.87 | 4.98 | 0.49 | 0.004 | | 0.018 | A | 1200 | Example of the invention |
| 7 | 0.002 | 0.08 | 0.99 | 15.1 | 1.87 | 4.98 | 0.49 | 0.004 | | 0.041 | B | 1150 | Example of the invention |
| E | 0.002 | 0.08 | 0.99 | 15.1 | 1.87 | 4.98 | 0.49 | 0.004 | | 1.980 | D | 1010 | Comparative steel |
| 8 | 0.002 | 0.56 | 0.55 | 30.5 | Not added | 3.05 | Not added | 0.002 | | 0.018 | A | 1090 | Example of the invention |
| 9 | 0.015 | 1.84 | 1.05 | 9.5 | 1.5 | 2.35 | 0.65 | 0.015 | | 0.011 | C | 1090 | Example of the invention |
| 10 | 0.004 | 0.15 | 1.51 | 24.5 | Not added | 2.68 | Not added | 0.005 | Ti/0.25 | 0.032 | B | 1090 | Example of the invention |
| 11 | 0.005 | 0.04 | 1.05 | 20.8 | Not added | 4.58 | 0.35 | 0.005 | Zr/0.12 | 0.012 | A | 1090 | Example of the invention |
| 12 | 0.002 | 0.07 | 0.09 | 22.5 | 0.54 | 3.05 | 0.25 | 0.005 | Al/0.15 | 0.021 | A | 1150 | Example of the invention |
| 13 | 0.005 | 0.25 | 1.08 | 15.4 | 1.85 | 2.99 | 0.48 | 0.005 | V/0.15, Al/0.05 | 0.009 | A | 1050 | Example of the invention |
| 14 | 0.004 | 0.25 | 0.25 | 9.5 | 3.05 | 3.07 | 0.45 | 0.005 | | 0.033 | B | 1090 | Example of the invention |
| 15 | 0.012 | 0.04 | 0.15 | 16.5 | Not added | 3.01 | 0.25 | 0.015 | Ti/0.08, Ni/0.51, Cu/1.25 | 0.014 | B | 1070 | Example of the invention |
| 16 | 0.011 | 0.55 | 0.35 | 16.9 | Not added | 3.08 | 0.35 | 0.009 | Cu/0.43, Co/0.12 | 0.007 | B | 1080 | Example of the invention |
| 17 | 0.004 | 0.85 | 0.98 | 14.9 | 1.87 | 2.85 | 0.45 | 0.008 | B/0.0005, Ca/0.0015 | 0.007 | A | 1150 | Example of the invention |
| 18 | 0.005 | 0.84 | 0.88 | 16.4 | 1.68 | 3.07 | 0.65 | 0.007 | Mg/0.0008 | 0.015 | A | 1150 | Example of the invention |
| 19 | 0.007 | 0.88 | 0.85 | 16.4 | 1.68 | 3.09 | 0.5 | 0.007 | REM/0.08 | 0.025 | A | 1150 | Example of the invention |
| F | 0.007 | 0.63 | 0.41 | 11.2 | Not added | <0.02 | 0.004 | 0.007 | Ti/0.21 | <0.005 | D | 900 | SUH409L |
| G | 0.014 | 1.04 | 0.45 | 14.1 | Not added | <0.02 | 0.45 | 0.007 | | <0.005 | D | 1000 | Type 429Nb |
| H | 0.004 | 0.35 | 1.09 | 5.4 | Not added | 2.25 | 0.45 | 0.004 | | 0.009 | D | 1150 | Comparative steel |
| 20 | 0.004 | 0.08 | 0.89 | 14.9 | 1.89 | 5.85 | 0.48 | 0.005 | | 0.021 | A | 1190 | Example of the invention |
| 21 | 0.004 | 0.08 | 0.89 | 14.9 | 1.89 | 5.85 | 0.48 | 0.005 | | 0.086 | C | 1080 | Example of the invention |
| I | 0.004 | 0.08 | 0.89 | 14.9 | 1.89 | 5.85 | 0.48 | 0.005 | | 0.950 | D | 1000 | Comparative example |
| J | 0.004 | 0.08 | 0.89 | 14.9 | 1.89 | 5.85 | 0.48 | 0.005 | | 2.220 | D | 980 | Comparative example |
| K | 0.004 | 0.06 | 1.03 | 15.1 | 1.92 | 6.18 | 0.50 | 0.005 | | 0.028 | A | 1180 | Comparative example*1 |
| L | 0.004 | 0.06 | 1.03 | 15.1 | 1.92 | 6.18 | 0.50 | 0.005 | | 0.091 | C | 1040 | Comparative example*1 |
| M | 0.004 | 0.06 | 1.03 | 15.1 | 1.92 | 6.18 | 0.50 | 0.005 | | 2.240 | D | 980 | Comparative example*1 |
| N | 0.005 | 0.07 | 1.02 | 15.2 | 1.92 | 3.02 | 0.51 | 0.004 | | 0.009 | A | 1220 | Comparative example*2 |
| O | 0.005 | 0.07 | 1.02 | 15.2 | 1.92 | 3.02 | 0.51 | 0.004 | | 0.110 | D | 1040 | Comparative example*3 |
| P | 0.004 | 0.21 | 0.41 | 12.6 | 1.51 | 2.51 | 0.31 | 0.003 | Ni/0.03 | 1.660 | D | 1000 | Example in the related art*4 |

TABLE 1-continued

| No. | C | Si | Mn | Cr | Mo | W | Nb | N | other | Precipitated W | Average thermal expansion coefficient between 20° C. and 800° C. | Finish annealing temperature (° C.) | remarks |
|---|---|---|---|---|---|---|---|---|---|---|---|---|---|
| Q | 0.008 | 0.15 | 0.05 | 13.1 | 1.61 | 2.11 | 0.85 | 0.004 | Ni/0.03, Zr/0.28 | 1.490 | D | 1000 | Example in the related art*4 |
| R | 0.004 | 0.33 | 1.78 | 12.7 | 1.61 | 2.59 | 0.49 | 0.005 | Ni/0.55 | 1.700 | D | 1000 | Example in the related art*4 |
| S | 0.003 | 0.05 | 0.35 | 16.5 | 1.93 | 2.81 | 0.45 | 0.003 | Al/0.58 | 1.790 | D | 1000 | Example in the related art*5 |
| T | 0.005 | 0.68 | 1.2 | 18.2 | 2.22 | 3.12 | 0.50 | 0.006 | Zr/0.12 | 1.140 | D | 1000 | Example in the related art*5 |
| U | 0.009 | 0.08 | 0.57 | 18.8 | 1.21 | 3.52 | 0.45 | 0.009 | Mg/0.012 | 1.280 | D | 1000 | Example in the related art*5 |

*1cracks occurred in the adherence bending test (based on JIS B 7778)
*2surface roughness (orange peel) occurred in a bending portion, and in some parts, cracks occurred in the adherence bending test (based on JIS B 7778)
*3for thermal fatigue test
*4JP-A-2002-212685 (Table 1, steel numbers 22, 23 and 25)
*5JP-A-2004-76154, Japanese Patent Application No.2003-172437 (Table 1, numbers 3, 7 and 12)

The invention claimed is:

1. A ferritic Cr-contained steel wherein a cold rolled annealed sheet is annealed, after cold rolling, at a final annealing temperature at 1050 to 1200° C., comprising C of about 0.03% or less, Mn of about 5.0% or less, Cr of about 6 to about 40%, N of about 0.03% or less, Si of about 5% or less, and W of about 2.05 to about 6.0% in percent by mass, and Fe and inevitable impurities as the remainder, wherein precipitated W is 0.005% to 0.1% in percent by mass, and an average thermal expansion coefficient between 20° C. and 800° C. is less than about $12.6\times10^{-6}$/° C.

2. The ferritic Cr-contained steel according to claim 1, further comprising at least one selected from the group consisting of Nb of about 1% or less, Ti of about 1% or less, Zr of about 1% or less, Al of about 1% or less, and V of about 1% or less in percent by mass.

3. The ferritic Cr-contained steel according to claim 1 further comprising Mo of about 5.0% or less in percent by mass.

4. The ferritic Cr-contained steel according to claim 1, further comprising at least one selected from the group consisting of Ni of about 2.0% or less, Cu of about 3.0% or less, and Co of about 1.0% or less in percent by mass.

5. The ferritic Cr-contained steel according to claim 1, further comprising at least one selected the group consisting of B of about 0.01% or less and Mg of about 0.01% or less in percent by mass.

6. The ferritic Cr-contained steel according to claim 2, further comprising at least one selected from the group consisting of Ni of about 2.0% or less, Cu of about 3.0% or less, and Co of about 1.0% or less in percent by mass.

7. The ferritic Cr-contained steel according to claim 3, further comprising at least one selected from the group consisting of Ni of about 2.0% or less, Cu of about 3.0% or less, and Co of about 1.0% or less in percent by mass.

* * * * *